US010181236B2

(12) United States Patent
Goldstein et al.

(10) Patent No.: US 10,181,236 B2
(45) Date of Patent: Jan. 15, 2019

(54) EXTERNALLY HINGED CABINET DOOR FOR A GAMING MACHINE HOUSING

(71) Applicant: Bally Gaming, Inc., Las Vegas, NV (US)

(72) Inventors: Brian Goldstein, Las Vegas, NV (US); Philip Laroach, Henderson, NV (US); Martin Anthony Peltz, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/671,548

(22) Filed: Aug. 8, 2017

(65) Prior Publication Data

US 2018/0053373 A1 Feb. 22, 2018

Related U.S. Application Data

(60) Provisional application No. 62/376,554, filed on Aug. 18, 2016.

(51) Int. Cl.
*G07F 17/32* (2006.01)

(52) U.S. Cl.
CPC ..... *G07F 17/3216* (2013.01); *G07F 17/3213* (2013.01)

(58) Field of Classification Search
CPC ..... E05D 3/00; E05D 3/16; E05D 2003/166
See application file for complete search history.

(56) References Cited

U.S. PATENT DOCUMENTS

2001/0039762 A1* 11/2001 Giovannetti ..... E05F 1/1091 49/246
2016/0343204 A1* 11/2016 Maher ..... G07F 17/3216

* cited by examiner

*Primary Examiner* — Jay Liddle
*Assistant Examiner* — Alex F. R. P. Rada, II
(74) *Attorney, Agent, or Firm* — Marvin A. Hein

(57) ABSTRACT

Disclosed are a gaming terminal, a gaming cabinet and a gaming machine that include a housing having gaming components therein. The housing includes a door opening for accessing gaming components inside the housing and a door assembly having an open position that exposes the door opening, and a closed position that covers the door opening. At least one pair of externally mounted swing arms connect the door assembly to a biasing lift assembly within the housing. When the door assembly is in the closed position and a latching assembly is released, the biasing lift assembly urges the door assembly toward the open position.

11 Claims, 7 Drawing Sheets

EXTERNALLY HINGED CABINET DOOR FOR A GAMING MACHINE HOUSING

RELATED APPLICATIONS

This patent application claims the benefit of priority to U.S. Provisional Patent Application Ser. No. 62/376,554 filed on 18 Aug. 2016 and entitled "Externally Hinged Cabinet Door for a Gaming Machine Housing," the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to an externally hinged mechanism for a door used in an electronic wagering game machine housing.

BACKGROUND OF THE INVENTION

Gaming machines, such as slot machines, video poker machines and the like, have been a cornerstone of the gaming industry for several years. The aesthetics of gaming machines are important for attracting players and improving the overall appearance of machines. Further, there is a continued need for easing access to internal components of gaming machines to expedite the process of maintenance and troubleshooting. Therefore, there is a continuing need for improving gaming machines to be visually appealing, in addition to providing features making the machines easy to maintain using components that maintain structural integrity.

SUMMARY OF THE INVENTION

According to one or more aspects of the present invention, a gaming terminal, gaming cabinet or gaming machine primarily dedicated to playing a casino wagering game includes a housing configured to house gaming components and provide a door opening permitting access to the gaming components, a door assembly having an open position that exposes the door opening and a closed position that covers the door opening and a pair of external swing arms, each external swing arm having a first end and a second end, the first end being pivotally connected to the door assembly and the second end being pivotally connected to a biasing lift assembly within the housing. In the closed position, the biasing lift assembly imposes a bias on the door assembly to urge the door assembly toward the open position when the door assembly is unlatched The externally mounted swing arms provide additional space inside the housing over internally-mounted designs and provide an ornamental feature as well.

In accordance with one or more other aspects of the present invention, a method for accessing gaming components inside a gaming cabinet includes the steps of closing the door assembly to the closed position, via the biasing lift assembly, placing a bias on a mount connected to the external swing arms, and latching the door assembly. The method further includes steps of unlatching the door assembly and, in response to unlatching the door assembly, urging the door assembly to move from the closed position to the open position in response to the bias. The gaming cabinet includes a housing configured to enclose gaming components and provide a door opening permitting access to the gaming components, a latchable door assembly having an open position that exposes the door opening and a closed position that covers the door opening, and a pair of external swing arms, each external swing arm having a first end and a second end, the first end being pivotally connected to the door assembly and the second end being pivotally connected to a biasing lift assembly within the housing, Additional aspects of the invention will be apparent to those of ordinary skill in the art in view of the detailed description of various embodiments, which is made with reference to the drawings, a brief description of which is provided below.

Figure 1:
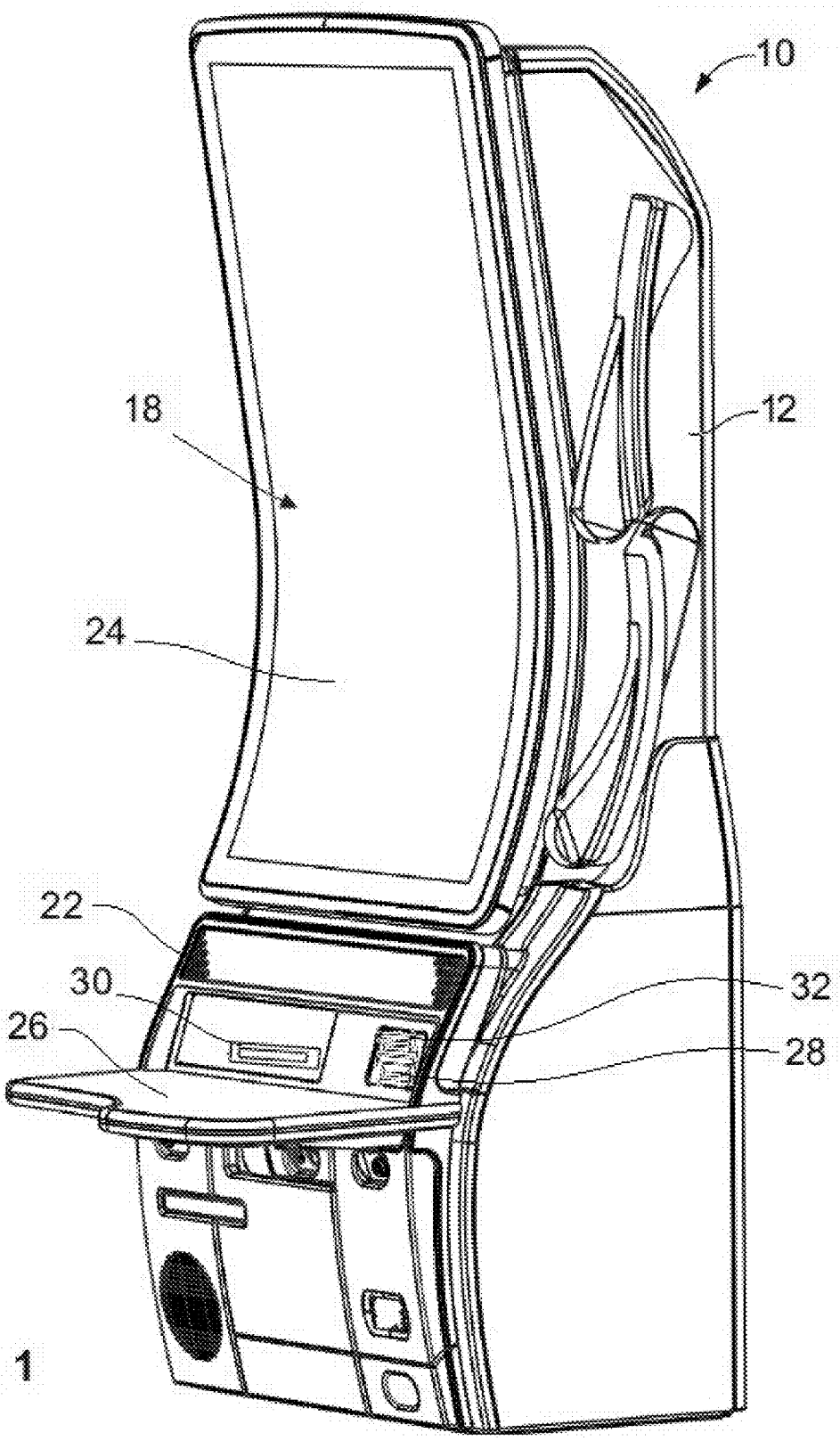
FIG. 1 is an isometric view of a free-standing gaming machine according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a free-standing gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may or may not be primarily dedicated for use in playing wagering games. An exemplary type of gaming machine is disclosed in U.S. Pat. No. 6,517,433, which is incorporated herein by reference in its entirety.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door.

The input devices, output devices, and input/output devices are disposed on, and securely coupled to, the cabinet 12. By way of example, the output devices include a primary display 18, and one or more audio speakers 22. The primary display 18 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary display, a button panel 26, which may comprise physical button switches (not shown) or a touch-based button panel such as an iDeck® by Bally Gaming, a bill/ticket acceptor 28, a player tracking system panel 30 which may include a card reader/writer, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, button panel 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
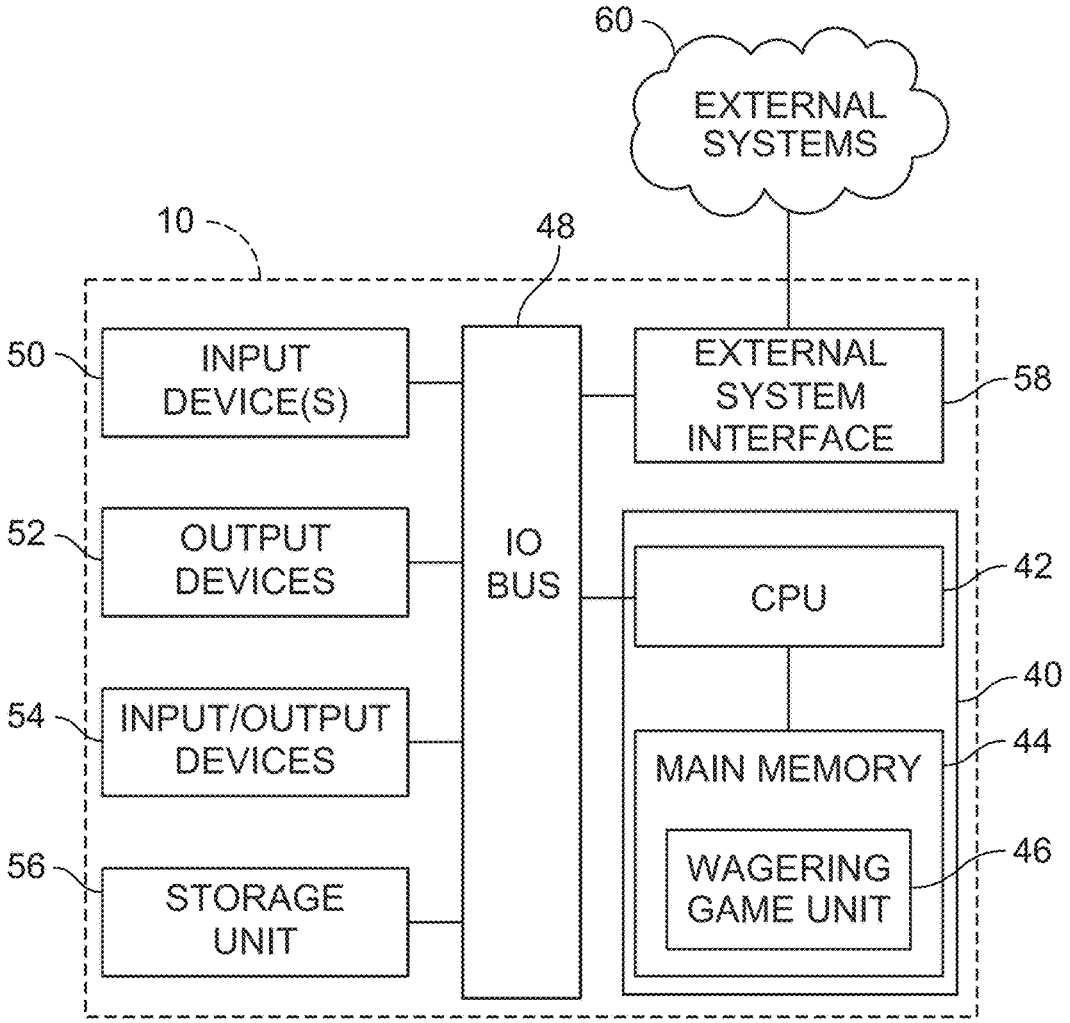
FIG. 2 is a schematic view of a gaming system including the gaming machine.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compares it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
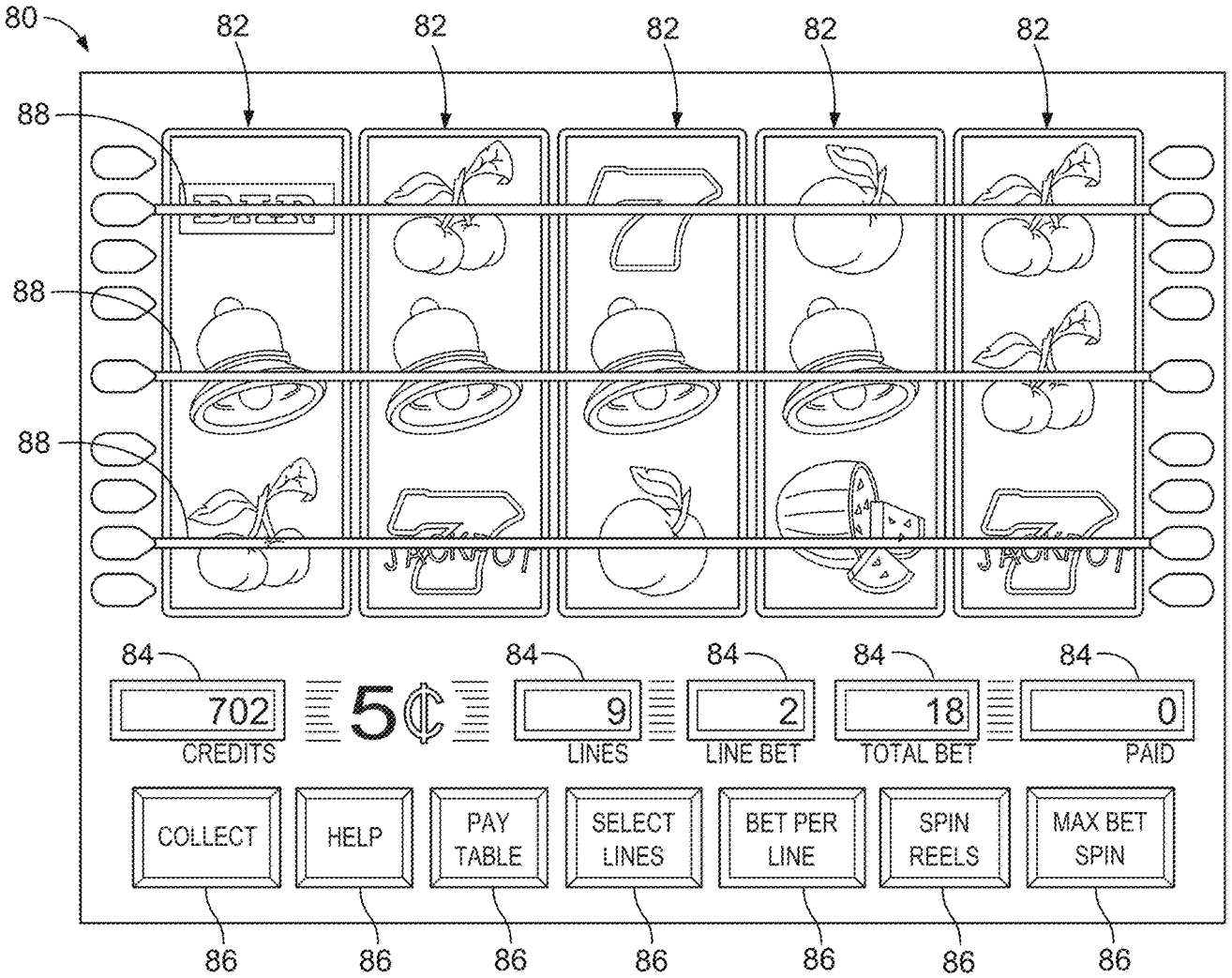
FIG. 3 is an image of an exemplary basic-game screen of a wagering game displayed on the gaming machine.

Referring now to FIG. 3, there is illustrated an image of a basic-game screen 80 adapted to be displayed on the primary display 18. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4A:
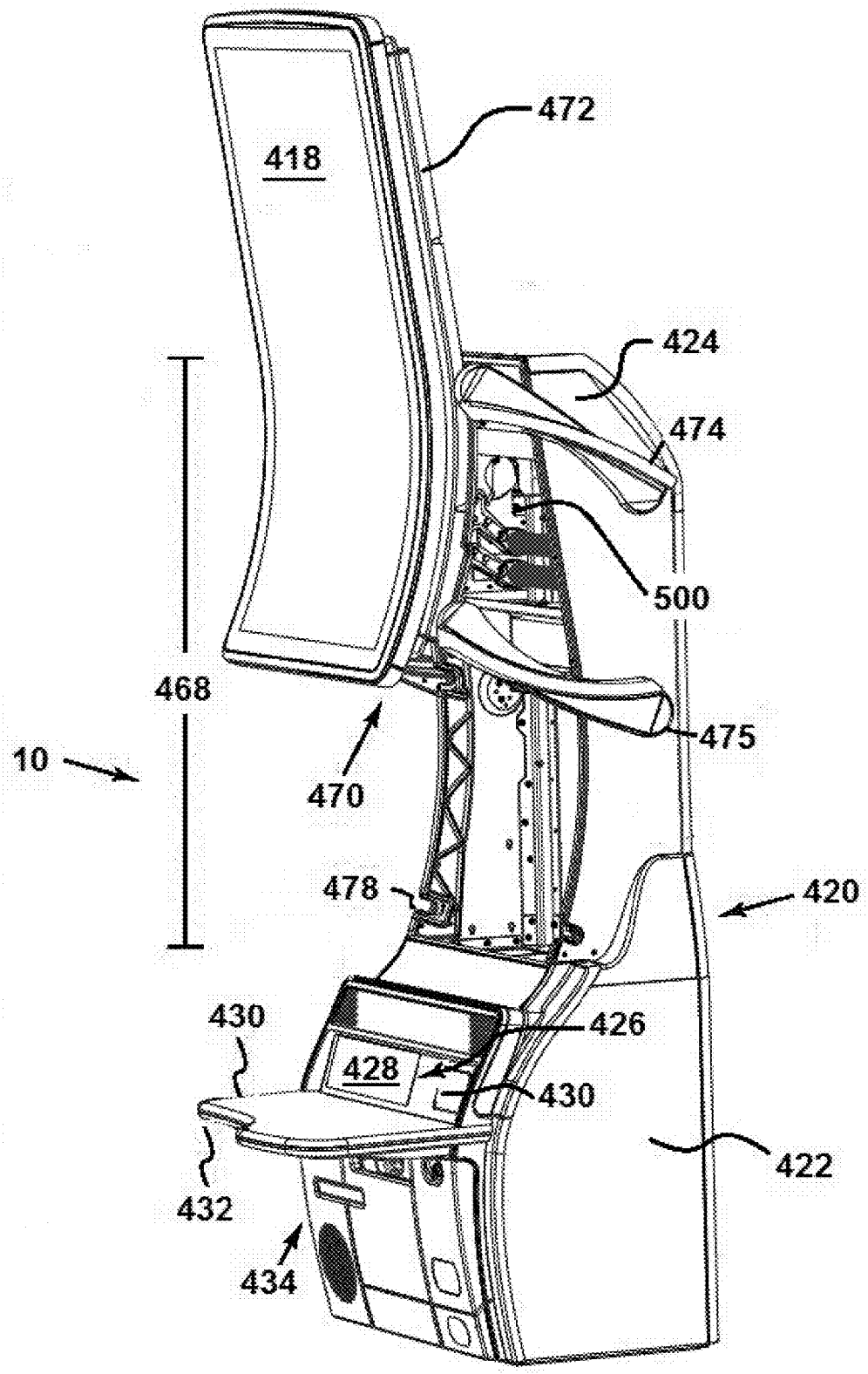
FIG. 4A is an isometric view of the gaming machine with its door proximate to a fully open position.
Figure 4B:
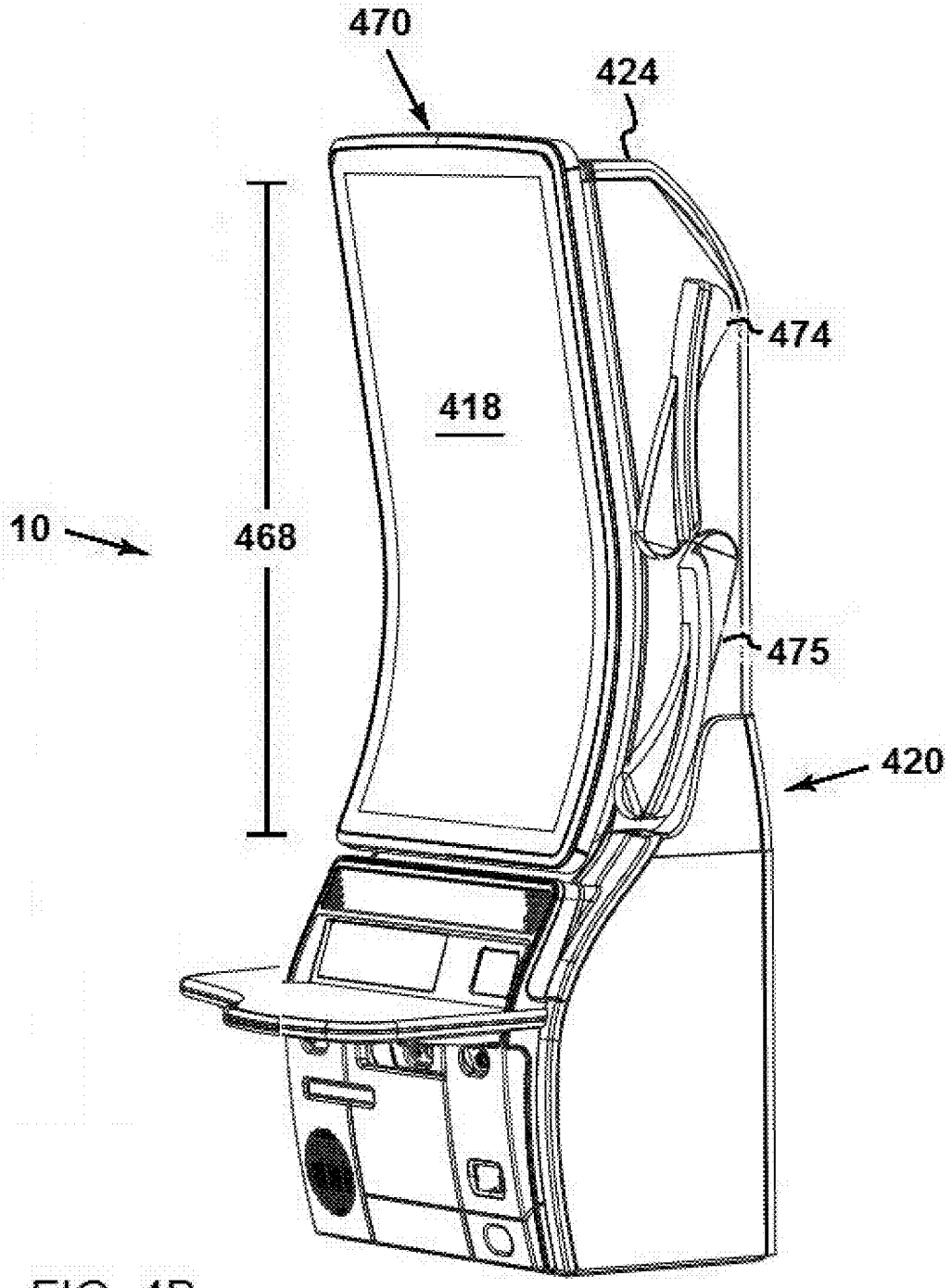
FIG. 4B is an isometric view of the gaming machine with its door in the closed position.
Figure 5:
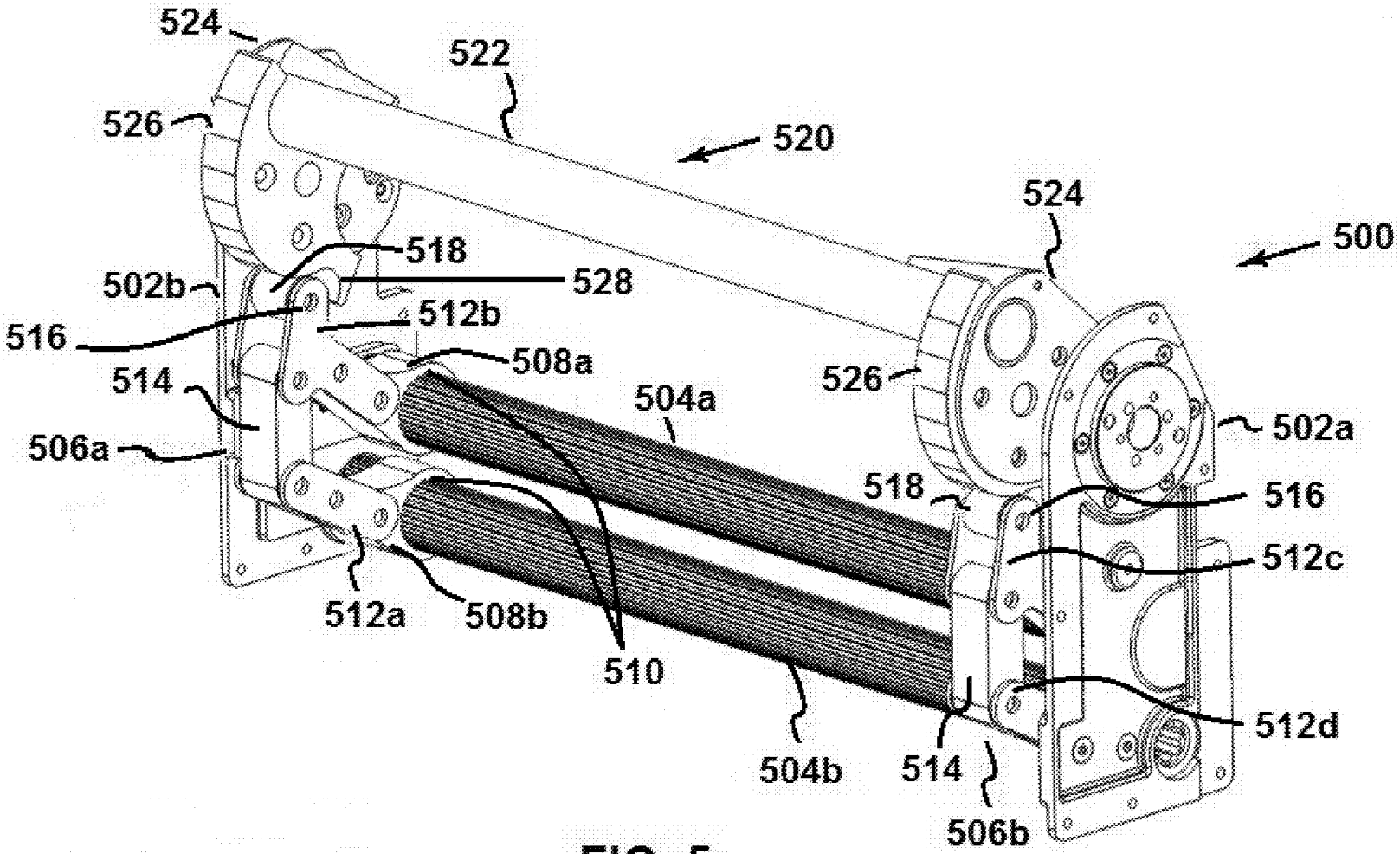
FIG. 5 is an isometric view of an exemplary torsion unit in accordance with one or more embodiments.

Referring now to FIGS. 4A, 4B and 5, in accordance with one or more embodiments, to enclose and support the components for the gaming machine 10, a cabinet 420 is provided. The cabinet 420 includes a base 422 with an upstanding tower 424. The base 422 may enclose electronic components such as those described in FIG. 2 and present at its exterior a player interface 426 including a player tracking module having an interface video display 428 and card reader 430. The base 422 also supports an ergonomic platform 432 which may include or support player input apparatus such as a keypad or video touch screen input panel for interacting with the game presented at the gaming machine 10 or to act as an armrest. The base 422 may include a lower door assembly 434 to provide access to the interior of the base 422.

The tower 424 supports an upper door assembly 470 which includes a video display 418 mounted in a portrait mode. As shown the video display 418 may be curved or include a curved portion. Alternatively the video display 418 may be a flat-screen video display. To support and mount the video display 418 the upper door assembly 470 includes a rigid frame 472 which, as shown in FIG. 4A, may be fashioned to follow the curvature or profile of the video display 418 for the support thereof.

The upper door assembly 470 is configured to move between an open position, exposing the door opening 468 (FIG. 4A), and a closed position covering the door opening 468 (FIG. 4B). When the upper door assembly 470 is closed, it secures the interior of the tower 424. When open, it provides access to the interior of the tower 424 and the rear of the video display 418. For example components such as some of the components of FIG. 2 or other peripherals may be accessed from the interior of the tower 424 or components in the base 422 may be better accessed from above through the interior of the tower 424.

Providing side mounted hinges for the video display 418 and frame 472 is less desirable because opening the upper door assembly 470 to either side of the tower 424 may interfere with the play at the adjacent gaming device and/or alter the weight distribution, perhaps making the gaming machine 10 unstable. Accordingly the upper door assembly 470 is pivotally connected at each side to outer swing arms 474 and 475. In addition to being functional, outer swings arms 474 and 475 provide a distinctive ornamental appearance to the cabinet 420. The outer swing arms 474 and 475 support and guide the opening of the video display 418 and its frame 472 and are each pivotally secured at one end to the frame 472 and at the other end to the tower 424. The upper swing arms 474, 475 are vertically spaced and are arranged to rotate in parallel to accommodate the rotation of the frame 472 and video display 418 outwardly and upwardly from the tower 424, as shown in FIG. 4A, to reveal the interior of the tower 424 and the rear of the frame 472 and video display 418 to a fully open and raised position.

In accordance with one or more embodiments, to impose a bias to counteract the weight of the frame 472 and video display 418, the door assembly 470 also include a biasing lift assembly 500 disposed in the tower 424. In the embodiment shown, outer swing arms 474 interact with the biasing lift assembly 500 while lower outer swing arms 475 provide dimensional control of the 4-bar geometry of the frame 472. Mounting of the outer swing arms 474 and 475 external to the tower 424 provides additional space for any components, such as those in FIG. 2, within the tower 424, particularly in the space located between outer swing arms 475. In one or more embodiments, lower outer swings arms 475 may also, or alternately, be connected to the biasing lift assembly. In still other embodiments, a single pair of centrally mounted outer swing arms may interact with the biasing lift assembly 500 without deviating from the scope of the invention.

In accordance with one or more embodiments, FIG. 5 illustrates an example of a suitable biasing lift assembly 500, such as a torsion unit manufactured by Southco Corporation of Concordville, Pa. Unlike the use of gas struts to provide lift or support, use of such a counterbalance unit provides a much longer duty cycle before any reduction in performance and is less susceptible to environmental changes in, for example, temperature or humidity. The biasing lift assembly 500 includes outer brackets 502*a,b* secured to the interior of the tower 424 and securing a pair of parallel arranged torsion bars 504*a,b* which are preferably splined on their exterior to cooperatively mount torsion arm articulated links 506*a,b*. Each of the articulated links 506*a,b* has upper and lower shoulders 508*a,b*, each including a splined bore 510 to secure the shoulders 508*a,b* to the torsion bars 504*a,b*, respectively. Links 512*a-d* are connected to the shoulders 508*a,b* for rotation therewith and the links 512*a,b* are pivotally connected to a supporting spacer 514. Links 512*a,b* include an extending foot 516 supporting a roller 518. In the configuration shown in FIG. 4A, the door assembly 470 is in an open position where a bias is imposed by the torsion bars 504*a,b* to hold the door assembly 470 in the open position.

To cooperate with the lift assembly 500, a door assembly mount 520 includes a rail 522 extending between a pair of cooperatively configured cams 524 which define an arcuate cam surface 526 to each engage a roller 518. The rear of the frame 472 is secured to the rail 522 as by fasteners or by one or more hangers (not shown). Each cam surface 526 terminates at a notch 528 having a configuration to receive and engage the roller 518.

To close the door assembly 470 from the fully open position shown in FIG. 4A to the fully closed position shown in FIG. 4B, a technician moves the video display 418 and frame 472 forward and down, guided by the rotation of the outer swing arms 474 and 475. This movement causes the notches 528 to engage the rollers 518 and articulate the links 506*a,b*, whereby the shoulders 508*a,b* impose a twist on the torsion bars 504*a,b* that results in a bias on the mount 520. As the video display 418 and its frame 472 are closed to the tower 424, the outer swing arms 474 and 475 and articulated links 506*a,b* accommodate the lowering as well as the movement of the video display 418 and frame 424 toward the closed position against the tower 424. A latching assembly includes receiving slots 478 on the tower 424 to receive fingers (not shown) on the frame 472 to latch the video display 418 and frame 472 in a closed position. In the closed position the torsion bars 504*a,b* impose a bias on the shoulders 508*a,b* of the articulated links 506*a,b* to urge the video display 418 and frame 472 toward the open position. When an attendant unlatches the latching assembly, releasing the video display 418 and frame 472 from the tower 424, this bias counteracts the weight of the video display 418 and frame 472 so that little or no force is required to move the video display 418 and frame 472 to the open position. In the open position, access may be had to the interior of the tower 424. In one or more embodiments, the bias may be sufficient to raise the video display 418 and its frame 472 with no effort by the attendant.

Figure 6:
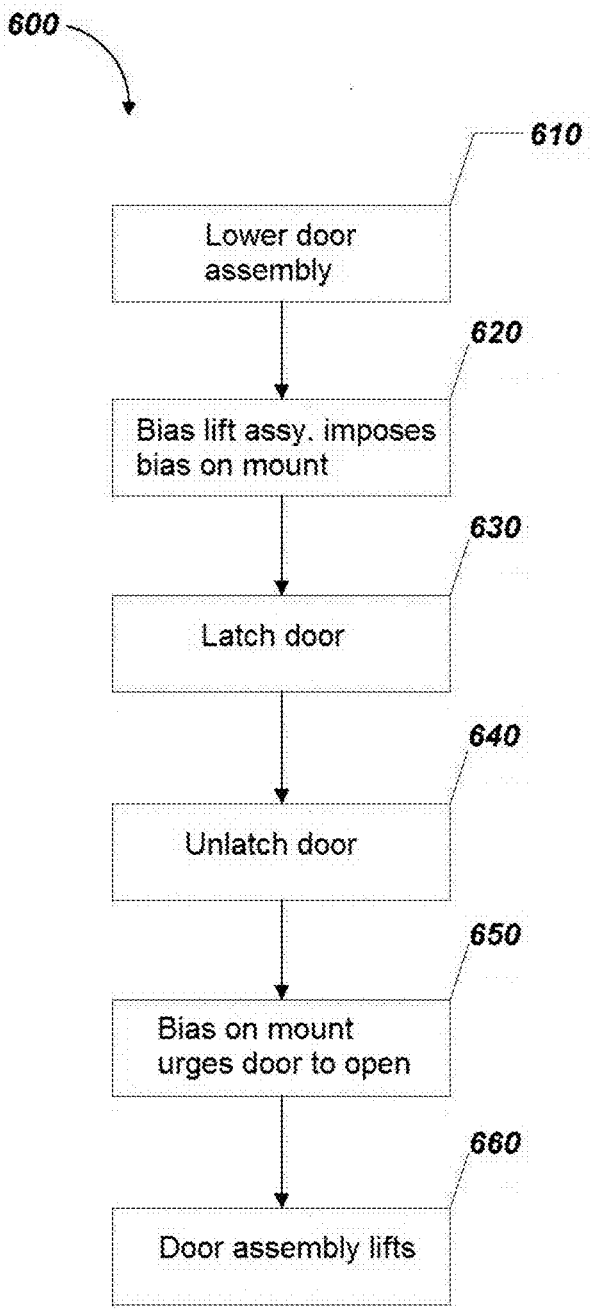
FIG. 6 is a flowchart for a method in accord with at least some aspects of the disclosed concepts.

FIG. 6 shows one example of various operations 600 performed in accord with one aspect of the present concepts including step 610, lowering the door assembly toward the closed position. As described above, as a technician moves the door assembly forward and down, guided by the rotation of the outer swing arms, the bias lift assembly imposes a twist on the torsion bars that results in a bias on the mount attached to the door assembly (step 620). As the door assembly is closed, the outer swing arms and articulated links accommodate the lowering as well as the movement of the door assembly, comprising the video display and frame, toward the closed position against the tower. A latching assembly includes receiving slots on the tower and fingers on the frame to latch the door assembly in a closed position (step 630). The latching assembly may include one or more locks.

To reverse the process, the technician unlocks any locks and releases the latching assembly, unlatching the door from the tower (step 640). Once released from the tower, the bias placed on the mount urges the door into an open position (step 650). Carried on the external swing arms, the door assembly is lifted away from the tower toward to fully open raised position (step 660).

FIG. 6, described by way of example above, represents one set of steps to perform the above described functions associated with the disclosed concepts.

In one or more embodiments, coiled springs may take the place of the one or more torsion bars described above. Thus, each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A gaming terminal comprising:

a housing configured to house gaming components and provide a door opening permitting access to the gaming components;

a door assembly having an open position that exposes the door opening and a closed position that covers the door opening; and a pair of external swing arms, each external swing arm having a first end and a second end, the first end being pivotally connected to the door assembly and the second end being pivotally connected to a biasing lift assembly within the housing; and wherein, in the closed position, the biasing lift assembly comprises one or more torsion bars and imposes a bias on the door assembly to urge the door assembly toward the open position when the door assembly is unlatched, wherein moving the door assembly from the open position to the closed position imposes a twist on the one or more torsion bars to place a bias on a mount of the biasing lift assembly.

2. The gaming terminal of claim 1, further comprising a second pair of external swing arms, each external swing arm of the second pair having a first end and a second end, the first end being pivotally connected to the door assembly and the second end being pivotally connected to the housing.

3. The gaming terminal of claim 1, wherein the pair of external hinge arms are positioned symmetrically in respect to the housing.

4. The gaming terminal of claim 1, further comprising a latching assembly configured to latch the door assembly to the housing when in the closed position, the latching assembly being releasable to allow the door assembly to be moved to the open position.

5. A gaming cabinet comprising:

a housing configured to enclose gaming components and provide a door opening permitting access to the gaming components;

a latchable door assembly having an open position that exposes the door opening and a closed position that covers the door opening; and a pair of external swing arms, each external swing arm having a first end and a second end, the first end being pivotally connected to the door assembly and the second end being pivotally connected to a biasing lift assembly within the housing;

wherein, in the closed position, the biasing lift assembly assembly comprises one or more torsion bars and imposes a bias on the door assembly to urge the door assembly toward the open position when the door assembly is unlatched, wherein when the door assembly is moved from the open position to the closed position, a twist is imposed on the one or more torsion bars resulting in a bias being placed on a mount of the biasing lift assembly.

6. The gaming cabinet of claim 5, further comprising a second pair of external swing arms, each external swing arm of the second pair having a first end and a second end, the first end being pivotally connected to the door assembly and the second end being pivotally connected to the housing.

7. The gaming cabinet of claim 5, wherein the pair of external hinge arms are positioned symmetrically in respect to the housing.

8. The gaming cabinet of claim 5, further comprising a latching assembly configured to latch the door assembly to the housing when in the closed position, the latching assembly being releasable to allow the door assembly to be moved to the open position.

9. A method for accessing gaming components inside a gaming cabinet, the gaming cabinet including a housing configured to enclose gaming components and provide a door opening permitting access to the gaming components, a latchable door assembly having an open position that exposes the door opening and a closed position that covers the door opening, and a pair of external swing arms, each external swing arm having a first end and a second end, the first end being pivotally connected to the door assembly and the second end being pivotally connected to a biasing lift assembly within the housing, the biasing lift assembly comprising one or more torsion bars, the method comprising:

closing the door assembly to the closed position;

via the biasing lift assembly, placing a bias on a mount connected to the external swing arms by imposing a twist on the one or more torsion bars;

latching the door assembly;

unlatching the door assembly; and in response to unlatching the door assembly, urging the door assembly to move from the closed position to the open position in response to the bias.

10. The method of claim 9, wherein the urging step includes causing each external swing arm to pivot about its first and second ends.

11. The method of claim 9, further comprising a second pair of external swing arms, each external swing arm of the second pair having a first end and a second end, the first end being pivotally connected to the door assembly and the second end being pivotally connected to the housing, and wherein the urging step includes causing each external swing arm of the second pair to pivot about its first and second ends.

* * * * *